United States Patent [19]

Noritake

[11] 4,232,082

[45] Nov. 4, 1980

[54] ANTI-ELECTROSTATICALLY GUARDED WORSTED SUITING

[75] Inventor: Hiroshi Noritake, Takarazuka, Japan

[73] Assignee: Nippon Keori Kabushiki Kaisha, Kobe, Japan

[21] Appl. No.: 56,521

[22] Filed: Jul. 11, 1979

[51] Int. Cl.[2] ..... B32B 5/16

[52] U.S. Cl. ..... 428/225; 57/901; 428/253; 428/257; 428/258; 428/368; 428/373; 428/922

[58] Field of Search ..... 428/253, 257, 258, 259, 428/368, 373, 377, 922, 225, 224; 57/901

[56] References Cited

U.S. PATENT DOCUMENTS

| | | | |
|---|---|---|---|
| 2,845,962 | 8/1958 | Bulgen | 57/901 |
| 3,206,923 | 9/1965 | Price | 57/901 |
| 3,582,448 | 6/1971 | Okuhashi et al. | 57/901 |
| 3,586,597 | 6/1971 | Okuhashi | 57/901 |
| 3,706,195 | 12/1972 | Davis et al. | 57/901 |

*Primary Examiner*—James J. Bell

*Attorney, Agent, or Firm*—Toren, McGeady and Stanger

[57] ABSTRACT

An electrically less chargeable wool-polyester suiting woven or knitted mostly from a non-electroconductive yarn and partly from an electroconductive yarn of the type containing a carbon-black-coated mono-filament fiber. The suiting comprises 0.1% to 0.6% of the monofilament fiber for obtaining a necessary anti-electrostatic effect. The monofilament fiber in the electroconductive yarn is covered by wool and other fibers having an aggregate amount by weight more than its fivefold amount and an average single-fiber finess less than its one-fifth finess, so that it is prevented from appearing streaky on the surface of the suiting. The electroconductive yarn in the suiting is protected from interruption both in production and in use by the non-electroconductive yarn including polyester multi-filament fibers.

6 Claims, No Drawings

ANTI-ELECTROSTATICALLY GUARDED WORSTED SUITING

The present invention relates to an anti-electrostatically guarded worsted suiting of the type containing an electroconductive carbon-black-coated fiber, and more particularly to wool-polyester woven or knitted fabrics appearing no streaky shadows due to the contained electroconductive fiber, even it is of brilliant or light color.

In general, a wool-polyester suit is electrostatically charged to offend one who wears it in a heated room in dry winter. The charged suit gives an electric shock to the wearer in touch with a metallic ware earthed, twines round his body, and becomes dirty with electrically attracted dusts. Furthermore, the electric charge on the suit may have a danger to fire an inflammable article to explosion. For the purpose of guarding a suiting from the electric charge there have been proposed some methods, among which mixing a carbon-black-coated fiber in the suiting is the most practical one to obtain a permanently durable effect on worsted fabrics. However, the carbon-black-coated fiber has a problem to give dark stripes on the surface of the suiting, therefore being of no use in the suiting of other color than black, dark blue or the like. Another problem is that the known anti-electrostatically guarded suiting is required to contain more than 2% of the carbon-black-coated fiber to have a necessary effect with the result that it is costly in production and somewhat tactually different from the usual worsted one. The more the suiting contains the carbon-black-coated fiber, it will be the more different in all from the usual one. Accordingly, there is a demand for an electrically less chargeable worsted suiting that is neither different from the usual one nor streaky when it has a light or brilliant color.

It is the primary object of the present invention to provide an anti-electrostatically guarded worsted suiting, which is substantially free from streaky shadows due to contained carbon-black-coated fibers and similar both in production and in touch to the usual worsted suiting including polyester fibers.

Other and further objects, features and advantages of the invention will appear more fully from the following description.

Staples or filaments of synthetic fiber, such as polyamide, polyester and acrylic fiber, are coated by carbon-black emulsion and converted to electroconductive staple or filament fibers. The electroconductive staple is not suitable to the object of the invention. One reason for this is that the staple fiber of discontinuity has to be contained in a suiting remarkably more than the filament fiber of continuity for obtaining a predetermined anti-electrostatic effect, resulting in the suiting different in touch from the usual one. Another reason is that the staple fiber is insufficiently covered by wool and other fibers in a co-spun yarn and appears streaky in a suting. It will be understood that an electroconductive mono-filament fiber is more suitable to the inventive object than a multi-filament one, because the mono-filament fiber is more productive and better covered by wool and other fibers than the latter.

The inventor of this application has prepared a lot of worsted patterns of the type containing less than 1% of the mono-filament to test their appearance and electric chargeability. In the test of appearance, the streaky shadow due to the contained mono-filament is visually checked. The pattern is electrically charged in the following manner; it is placed on a sheet of acrylic fiber, which is supported by an earthed metal plate, and then rubbed predetermined times by a cloth of acrylic fiber wrapped on a tube of vinyl chloride, thus being electrostatically charged. The electric charge on the pattern is potentiometrically measured by a rotary sector type potentiometer, the probe of which is disposed 10 cm apart from and in front of the charged pattern vertically suspended from an insulated bar after it has been separated from the sheet by the bar in the direction of its warp or weft. As a tolerable potential limit for an anti-electrostatically guarded suit composed of less than 65% polyester, more than 35% wool, and less than 1% carbon-black-coated fiber is selected a value of 20 KV, which corresponds to 30–40% of the charge on the suit containing no electroconductive fiber. Such charge gives no more than a tolerable offence to the wearer. The electrostatic attraction of dust on the pattern is measured as follows: the charged pattern is placed over a laboratory dish in which pulverized cigarette ash is scattered and thereafter raised from the dish, the amount of attracted ash on it being visually checked and classified.

Upon the basis of the test results have been disclosed such relations between the electroconductive mono-filament and other non-electroconductive fibers as to attain the inventive object. The suiting of the invention is composed of a non-electroconductive wool-polyester core-spun yarn and an electroconductive spun yarn including as a covering wool and other fibers and as a core a carbon-black-coated mono-filament, which is contained in the suiting by 0.03% to 1.0%, more preferably 0.1% to 0.6% by weight. The covering fibers in the electroconductive yarn are arranged to have an aggregate amount by weight more than a fivefold amount of the mono-filament fiber and an average single-fiber finess equal to or less than a one-fifth finess of the same. The electroconductive yarn is desirable to be longitudinally, laterally or crosswise, generally equidistantly woven or knitted to the suiting. The electroconductive single yarn is spun from carbon-black-coated mono-filament and all wool or wool-polyester blended fiber sources and relatively highly twisted, by the use of a worsted spinning machine equipped with a core-filament feeding device. The non-electroconductive single yarn is similarly spun from polyester multi-filament and all wool or wool-polyester blended fiber sources. In preference, the wool content of the yarn is more than 35% and that of the suiting is equal to or more than 35%. In some case, the electroconductive and non-electroconductive single yarns are doubled to an electroconductive twine yarn.

In comparison with the known anti-electrostatically guarded suiting of 2–3% electroconductive fiber content, the inventive suiting including less than 1% electroconductive mono-filament fiber has a necessary anti-electrostatic effect or electric conductivity as well as a usual worsted touch. One reason for this advantage is that the mono-filament fiber is relatively resistible and protected by the sufficient amount of fine covering fibers against rupture in production and use. Another reason is that the non-electroconductive yarn including polyester filament has the same tensile property as the electroconductive yarn and defends the same with the result that there always remain a sufficient number of non-interrupted mono-filament fibers for giving a necessary electric conductivity to the suiting. The inventive suiting, even if it is of light or brilliant color, is free from such dark streaks as seen in the known suiting of the same color. This is attributed to that the covering wool fibers in the electroconductive yarn are so fine, massive and vulky as to prevent the mono-filament fiber from appearing dark streaky on the surface of the suiting.

The invention will be understood more readily by reference to the following examples; however, these examples are intended to illustrate the invention and are not to be construed to limit the scope of the invention.

EXAMPLE I Serges of 48/2 metric count twine yarn

A non-electroconductive single yarn of 48 metric count is spun to have 10 polyester multi-filament fibers of 3 denier as a core and wool fibers of 80/70 quality count or average denier of 4.2 as a covering. The polyester and wool contents of the yarn are 8% and 92%, respectively. The single yarn is doubled and twisted to a non-electroconductive twine yarn of 48/2 metric count. On the other hand, an electroconductive single yarn of the same 48 metric count is spun to have a 22-denier carbon-black-coated mono-filament fiber of synthetic polymer traded under the name of "METALIAN" as a core and the same covering fibers as mentioned above, the wool content being 94%. The both non-electroconductive and electroconductive single yarns are doubled and twisted to an electroconductive twine yarn of 48/2 metric count. The wool fiber in the electroconductive yarn has the amount, by weight, more than the sevenfold one of the mono-filament fiber and the average finess of a single fiber less than the latter.

The twine yarns are woven to various patterns of a worsted serge of 260 g/m$^2$, 78.5 warps per 25.4 mm and 69.0 wefts per 25.4 mm, in which the electroconductive yarn is generally equidistantly combined in the direction of warp or weft. The patterns are of eight sorts in respect to mono-filament fiber content and of four kinds in color; bleached white, beige, light blue and red. Each pattern has been tested for appearance, charged potential, and dust attraction and the result is shown in TABLE 1, in which the reference letters on n, t, and i indicate neglisibly streaky or dusty, tolerably streaky or dusty, and intolerably streaky or dusty, respectively.

TABLE 1

| No. of pattern | | 1 | 2 | 3 | 4 | 5 | 6 | 7 | 8 |
|---|---|---|---|---|---|---|---|---|---|
| mono-filament content | | | | | | | | | |
| in warp | % | none | none | none | none | 0.08 | 0.12 | 0.28 | 0.60 |
| in weft | % | none | 0.03 | 0.10 | 0.28 | none | none | none | none |
| streaky shadow on the surface of pattern | | | | | | | | | |
| bleached white | | none | i | i | i | i | i | i | i |
| beige | | none | n | n | n | n | n | n | n |
| light blue | | none | n | n | n | n | n | n | n |
| red | | none | n | n | n | n | n | n | n |
| charged potential when pattern is separated in the direction of | | | | | | | | | |
| warp | KV | 50 | 18.5 | 13.5 | 12.5 | 2.5 | 2.5 | 2.0 | 1.5 |
| | % | 100 | 37 | 27 | 25 | 5 | 5 | 4 | 3 |
| weft | KV | 52 | 4.7 | 2.6 | 2.6 | 14.6 | 13.5 | 11.4 | 8.3 |
| | % | 100 | 9 | 5 | 5 | 28 | 26 | 22 | 16 |
| attraction of dust when pattern is separated in the direction of | | | | | | | | | |
| warp | | i | i | t | t | t | n | n | n |
| weft | | i | t | n | n | i | t | t | t |

TABLE 1 shows that the pattern of light or brilliant color except white has no appearance of dark stripes due to the carbon-black-coated mono-filament fiber. The pattern of 0.3% mono-filament content has an electric conductivity barely measured up to the predetermined tolerable limit. The mono-filament fiber content of 0.1% to 0.6% gives a satisfactory anti-electrostatic effect to the pattern on which the electric charge is less than 30% of that on the original pattern having no electroconductive yarn. The patterns of Nos. 2 to 8 are similar both in touch and in production to the original pattern of No. 1.

EXAMPLE II Knitted Shirting

A non-electroconductive single yarn of 48 metric count is spun to have as a core 16 polyester multi-filament fibers of 3-denier and as a covering wool and 3-denier-76 mm polyester staple fibers, the wool fiber being the same as in the previous example. An electroconductive single core-spun yarn has as a core the same mono-filament fiber as in the previous example and as a covering the same wool and polyester fibers as in the above-mentioned non-electroconductive single yarn. Various shirting patterns of 145 cm periphery and 330 g/m are knitted from the single yarns by the use of a circular knitting machine of 26-inch diameter and 24 needles per inch. The electroconductive yarn contains 36.2% wool, 52.1% polyester, and 11.7% carbon-black-coated mono-filament and the non-electroconductive yarn includes 36.6% wool and 63.4% polyester. The pattern is of five sorts in respect to the mono-filament fiber content and of the same four kinds in color as in the previous example. The test results of each pattern are seen in TABLE 2, showing that the patterns of Nos. 2 to 5 are electrically less chargeable to keep within the tolerable extent and free from streaky shadows due to the mono-filament fiber except the white one. It will be seen from TABLE 2 that the mono-filament fiber content is at least 0.03%, preferably 0.1% to 0.6% in order to obtain a necessary anti-electrostatic effect. There is no essential difference both in touch and in production among the patterns inclusive of the original one of No. 1.

TABLE 2

| No. of pattern | | 1 | 2 | 3 | 4 | 5 |
|---|---|---|---|---|---|---|
| mono-filament content % | | none | 0.03 | 0.10 | 0.28 | 0.60 |
| streaky shadow on the surface of pattern | | | | | | |
| bleached white | | none | i | i | i | i |
| beige | | none | n | n | n | n |
| light blue | | none | n | n | n | n |
| red | | none | n | n | n | n |
| charged potential when pattern is separated in the direction of | | | | | | |
| length | KV | 63 | 21.4 | 15.8 | 12.0 | 12.0 |
| | % | 100 | 34 | 25 | 19 | 20 |
| width | KV | 65 | 4.6 | 2.6 | 2.6 | 2.0 |
| | % | 100 | 7 | 4 | 4 | 3 |

TABLE 2-continued

| No. of pattern | 1 | 2 | 3 | 4 | 5 |
|---|---|---|---|---|---|
| attraction of dust when pattern is separated in the direction of | | | | | |
| length | i | i | t | t | t |
| width | i | t | n | n | n |

EXAMPLE III Serge of 60/1 metric count yarn

Electroconductive and non-electroconductive core-spun single yarns of 60 metric count are prepared from the same fiber sources as those in the Example I, the wool content of the respective yarns being 85% and 80%. The mono-filament fiber in the electroconductive yarn is covered by the wool fibers, which are in weight 5.8 times as much as the mono-filament fiber.

The yarns are woven to a serge of 163 g/m$^2$, 119 warps per 25.4 mm and 106 wefts per 25.4 mm of which the patterns are of the same sorts and kinds as those in Example I. The test results are shown in TABLE 3, from which it is apparent that the mono-filament fiber content of 0.1% to 0.6% gives to the suiting a satisfactory anti-electrostatic effect without appearing streaky shadows on the surface except the white pattern.

TABLE 3

| No. of pattern | | 1 | 2 | 3 | 4 | 5 | 6 | 7 | 8 |
|---|---|---|---|---|---|---|---|---|---|
| mono-filament content | | | | | | | | | |
| in warp | % | none | none | none | none | 0.10 | 0.20 | 0.30 | 0.60 |
| in weft | % | none | 0.03 | 0.10 | 0.30 | none | none | none | none |
| streaky shadow on the surface of pattern | | | | | | | | | |
| bleached white | | none | i | i | i | i | i | i | i |
| beige | | none | n | n | n | n | n | n | n |
| light blue | | none | n | n | n | n | n | n | n |
| red | | none | n | n | n | n | n | n | n |
| charged potential when pattern is separated in the direction of | | | | | | | | | |
| warp | KV | 52 | 28.6 | 17.7 | 18.7 | 4.7 | 3.6 | 4.2 | 5.2 |
| | % | 100 | 55 | 34 | 36 | 9 | 7 | 8 | 10 |
| weft | KV | 50 | 4.0 | 3.5 | 4.0 | 4.0 | 28.0 | 20.0 | 19.0 |
| | % | 100 | 8 | 7 | 8 | 8 | 56 | 40 | 38 |
| attraction of dust when pattern is separated in the direction of | | | | | | | | | |
| warp | | i | i | t | t | t | n | n | n |
| weft | | i | t | t | n | t | t | t | t |

What is claimed is:

1. An anti-electrostatically guarded worsted suiting woven or knitted partly of an electroconductive core-spun yarn and mostly of a non-electroconductive core-spun yarn, which comprises 0.03% to 1.0% carbon-black-coated mono-filament fiber of synthetic polymer contained as a core in the electroconductive yarn and more than 35% wool fiber contained both in the electroconductive yarn and in the non-electroconductive yarn, the electroconductive yarn having as a covering for the mono-filament fiber wool-included fibers of which an aggregate amount is above the fivefold amount of the latter, and being laterally, longitudinally or crosswise equidistantly combined in the suiting, the wool-included fibers having the average single-fiber finess thereof equal to or less than the one-fifth finess of the mono-filament fiber, the non-electroconductive yarn including as a core polyester multi-filament fibers.

2. The suiting as claimed in claim 1, wherein the mono-filament fiber is present in an amount that is from 0.1% to 0.6% by weight of the suiting.

3. The suiting as claimed in claim 2, wherein the mono-filament fiber is of 22-denier.

4. The suiting as claimed in claim 2, wherein the wool-included fiber comprises more than 35% wool fiber of 80/70 quality count and less than 65% polyester fiber of 3 denier.

5. The suiting as claimed in claim 2, wherein the polyester multi-filament fiber consists of a plurality of single filament fibers of 3-denier.

6. The suiting as claimed in claim 2, wherein the electroconductive yarn comprises a folded yarn to which the electroconductive and non-electroconductive core-spun single yarns are twisted together.

* * * * *